United States Patent [19]

Salisbury

[11] 4,081,916

[45] Apr. 4, 1978

[54] QUICK LACE TIGHTENER FOR SHOES

[76] Inventor: Thomas Salisbury, Box 80033, College, Ak. 99701

[21] Appl. No.: 765,303

[22] Filed: Feb. 3, 1977

[51] Int. Cl.[2] ..... A43B 11/00

[52] U.S. Cl. ..... 36/50

[58] Field of Search ..... 36/50; 24/203, 143, 24/73 GC

[56] References Cited

U.S. PATENT DOCUMENTS 3,626,610 12/1971 Dassler ..... 36/50

FOREIGN PATENT DOCUMENTS 935,640 10/1973 Canada ..... 36/50

234,125 5/1911 Germany ..... 36/50

181,880 6/1922 United Kingdom ..... 36/50

*Primary Examiner*—Alfred R. Guest

*Attorney, Agent, or Firm*—Bacon & Thomas

[57] ABSTRACT

A generally conventional shoe having flaps with eyelets therethrough has laces extending from the eyelets in one flap through the eyelets in the other. A patch of "Velcro" type fastener fabric is secured to a leather patch having eyelets receiving the laces outwardly of the other flap and may be pulled over the one flap to tighten all laces an then may be engaged with a second patch of the fabric to hold the laces in tightened but easily released condition.

2 Claims, 2 Drawing Figures

QUICK LACE TIGHTENER FOR SHOES

BACKGROUND OF THE INVENTION

This invention is in the field of quick lace tightening arrangements for shoes, boots, or skates and the like.

Conventionally laced shoes are difficult to tighten and tie for many people. For example, certain handicapped persons and small children find it almost impossible to do. Also, there are times when it is desirable to tighten the laces of shoes previously tied, which is time consuming and often inconvenient or difficult.

SUMMARY OF THE INVENTION

In general, the present invention contemplates the provision of a patch of fastener fabric secured to the lace coming through eyelets on one side of a shoe and a patch of complementary fastener fabric secured to the other side of the shoe.

It is, therefore, a principal object of this invention to provide means for quickly and simultaneously tightening and securing the lace in a shoe.

A further object is to provide means as set forth above readily applicable to conventional shoes.

A still further object is to provide such means that are inexpensive to produce yet reliable and efficient in operation.

DESCRIPTION OF A PREFERRED EMBODIMENT

Figure 1:
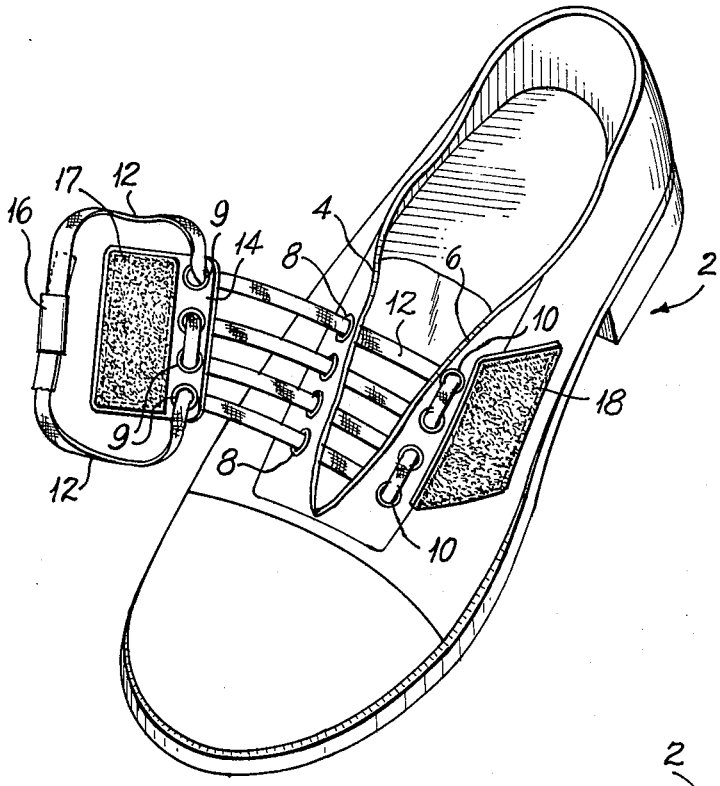
FIG. 1 is a perspective view of a shoe embodying the present invention with the lace loosened.

Throughout the following description the term "fastener fabric" is used to refer to materials of the type commonly known as "Velcro" wherein a multiplicity of resilient hook-like filaments project from one surface and are engageable with loops or the like projecting from a surface of a complementary piece of material.

In the drawings, numeral 2 designates generally a shoe which may be considered to be conventional and having closure flaps 4 and 6, provided with eyelets 8 and 10, respectively. The shoe thus far is conventional and is normally employed by stringing a single lace alternately through the eyelets 8 and 10, then tensioning the same to draw the closure flaps 4 and 6 together. However, it is usual that when the laces are conventionally tightened and tied at the start of the day or certain activities, such as skating, the laces will loosen during wearing of the shoe and necessitate tightening for comfort or otherwise. Heretofore it has been necessary to untie the laces and retighten them, an activity requiring the use of both hands. In some instances, such as when skating, it is necessary to frequently tighten or readjust the tension of shoelaces and that normally requires that the user be seated and employ both hands.

As shown in the drawings, however, the lace 12 is threaded through adjacent eyelets 10, then through adjacent eyelets 8 and through corresponding eyelets 9 in a leather patch 14, all as clearly shown in FIG. 1. The ends of the lace 12 extend outwardly through the outer eyelets 9 and are adjustably secured to each other frictionally by a crimped or flattened copper clamp tube 16 or other suitable equivalent means. For convenience of illustration, the ends of the lace 12 are shown in FIG. 1 extending a considerable distance outwardly of the eyelets 9 to the clamp 16. In practice, the ends will extend directly from each of the outer eyelets 9 to the other with the clamp or equivalent means overlying the intermediate eyelets 9.

The leather patch 14 is of substantial size and has a patch 17 of fastener fabric adhered or stitched thereon, outwardly of the eyelets 9.

Figure 2:
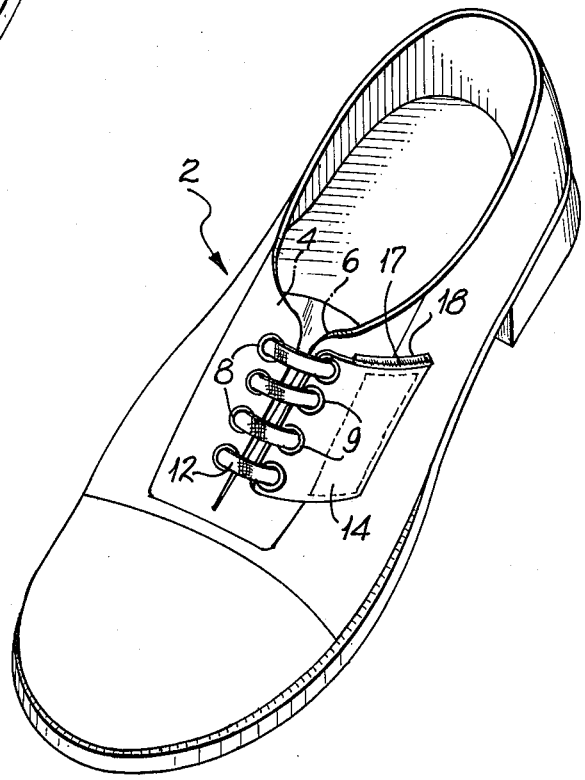
FIG. 2 is a view similar to FIG. 1 with the lace tightened and secured.

Attached to the side of the shoe 2 outwardly of the eyelets 10 is a further patch 18 of complementary fastener fabric. Thus, it is only necessary for the user to grasp the patch 14, draw the laces taut and move patch 14 toward the patch 18 while maintaining the lace 12 under the desired tension. The patch 17 may then be pressed against the patch 18 to secure the same thereto, all as in the well known manner of engaging such materials. The lace will thus be releasably held in the desired tensioned condition and the clamp 16 and lace ends will be concealed by leather patch 14, as already shown in FIG. 2. Since the patch 18 is larger than patch 17, the patch 14 may be secured in selectively different positions on 18, thus enabling the user to apply any desired tension.

Obviously, the invention is adapted for use by one-armed or otherwise handicapped persons and further facilitates retightening the laces at any time and requiring only the use of a single hand to do so. For example, a skater may retighten the laces of his shoe skates while standing on the ice and by using only a single hand to release the patch 17 from patch 18, draw the laces tighter and reengage the patches.

From the foregoing description it will be apparent that the length of lace 12 used may be easily adjusted.

It is contemplated that the leather patches with eyelets and fastener fabric along with patches 18 and laces 12 may be sold as kits for the buyer to apply to selected shoes.

Whether the invention is purchased in kit form or applied by the shoe manufacturer, the leather patch 14 will be selected to match the leather of the shoe on which it is used.

While a single specific embodiment of the invention has been shown and described herein, the same is merely illustrative of the principles involved and modifications may be made within the scope of the appended claims.

I claim:

1. A quick lace tightener for shoes, a shoe having adjacent closure flaps, each provided with a plurality of eyelets, comprising:

a shoe lace member laced through and extending from the eyelets of one flap and outwardly through the eyelets of the other flap;

a first patch of fastener fabric secured to the outer ends of said shoe lace members; and a second path of complementary fastener fabric secured to the outer surface of said shoe adjacent to said one flap whereby said first patch may be pulled toward said second patch to tighten said lace and draw said flaps together and then engaged with said second patch to hold said lace in tensioned condition, said lace being threaded through eyelets in a leather patch having said first patch of said material secured thereon.

2. A lace tightener as defined in claim 1 wherein the ends of said lace are adjustably secured together adjacent said leather patch in position to be covered thereby when said first patch engages said second patch.

* * * * *